United States Patent [19]

Kopel

[11] Patent Number: 4,561,393

[45] Date of Patent: Dec. 31, 1985

[54] SEALED UNIT FOR HYDRAULIC LIFTER

[76] Inventor: Howard J. Kopel, Rte. 2, Box 13, Hooker, Okla. 73945

[21] Appl. No.: 620,338

[22] Filed: Jun. 13, 1984

Related U.S. Application Data

[63] Continuation-in-part of Ser. No. 384,276, Jun. 2, 1982, Pat. No. 4,466,280.

[51] Int. Cl.[4] ..... F01L 1/14; F01L 1/24

[52] U.S. Cl. ..... 123/90.48; 123/90.55

[58] Field of Search ..... 123/90.14, 90.55, 90.54, 123/90.57, 90.58, 90.59, 90.48; 267/126; 188/269

[56] References Cited

U.S. PATENT DOCUMENTS

| | | | |
|---|---|---|---|
| 2,308,858 | 3/1940 | Burkhardt | 123/90.54 |
| 2,542,036 | 2/1951 | Knaggs | 123/90.59 |
| 3,426,651 | 2/1969 | Arendarski | 188/269 |
| 3,879,023 | 4/1975 | Pearce et al. | 188/269 |

FOREIGN PATENT DOCUMENTS

| | | | |
|---|---|---|---|
| 146210 | 11/1980 | Japan | 123/90.57 |

*Primary Examiner*—Craig R. Feinberg
*Assistant Examiner*—David A. Okonsky
*Attorney, Agent, or Firm*—Fidelman, Wolffe & Waldron

[57] ABSTRACT

Sealed system hydraulic valve lifters wherein pressurized gas functions as the takeup spring. The sealed system allows great choice in the hydraulic fluid.

3 Claims, 2 Drawing Figures

SEALED UNIT FOR HYDRAULIC LIFTER

Figure 1:
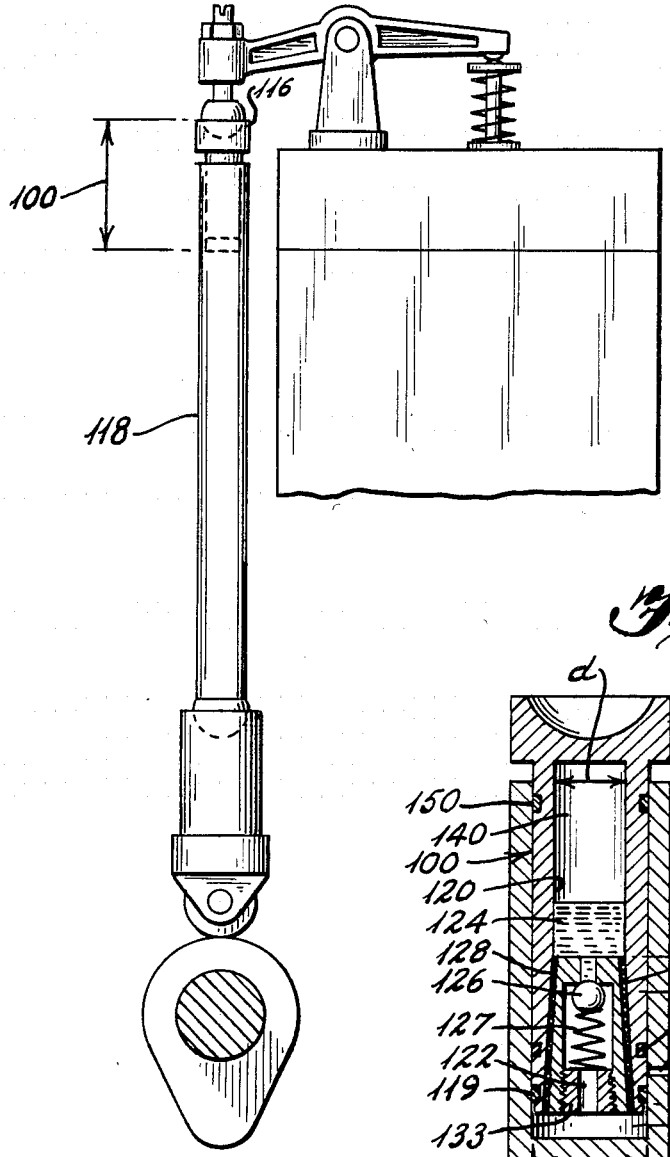

This is a continuation-in-part of co-pending Ser. No. 384,276 filed June 2, 1982, now U.S. Pat. No. 4,466,280.

This invention relates to hydraulic valve lifters and in particular, to a hydraulic lifter wherein pressurized gas is adapted to carry out the function of the takeup spring.

BACKGROUND OF THE INVENTION

The hydraulic valve lifter provided on internal combustion engines to automatically compensate for dimensional changes in the valve train must be matched closely to the characteristics of the valve on which the hydraulic lifter is installed, and the close match should be maintained over the useful life of the combustion engine.

The fluid reservoir that forms part of most hydraulic lifters have two inherent disadvantages; they are open to the atmosphere and they form natural traps.

Exposing the hydraulic fluid to the atmosphere allows oxidation and evaporation of the hydraulic fluid and in addition, an entranceway for foreign material which then accumulates in the trap structure. Oxidation and/or evaporation cause viscosity shifts in the hydraulic fluid as, for example, by formation of compounds that alter the original fluid viscosity properties. Foreign material, such as dust suspended in the hydraulic fluid, will eventually interfere with the intended operation if circulated through the various moving and non-moving parts of the hydraulic valve lifter.

All open reservoir lifters have the problems alluded to above, regardless of whether they are the flood type or manual fluid make-up type. The obvious solution is to seal the fluid reservoir. Sealing, however, may present still a different set of problems. Pressure may build up in the fluid reservoir which will reduce the differential across the orifice in the hydraulic lifter and reduce the lifter collapse rate. Without adequate control, the collapse rate may be reduced to zero and the engine valve spring then may experience excessive unloading. Still, in principle, a factory assembled presealed hydraulic valve lifter assembly should facilitate installation of the lifter on the engine and, moreover, the hydraulic valve lifter should undergo essentially no changes either in crucial dimensions or in operating characteristics during its normal use life.

Such a hydraulic valve lifter assembly forms the subject matter of this invention. The possibility of pressure buildup in the fluid reservoir has been made into an advantageous feature of the invention hereof.

The object of this invention is to provide a reliable gas filled sealed unit hydraulic valve lifter.

BRIEF STATEMENT OF THE INVENTION

The sealed hydraulic valve lifter of this invention comprises, in many respects, a typical rod and a shell assembly in that the shell assembly contains a reservoir chamber and together with the rod forms a pressure chamber for the hydraulic fluid. As is customary in hydraulic valve lifters, the reservoir chamber is connected to the pressure chamber by a metering orifice, through which hydraulic fluid passes from the pressure chamber into the reservoir chamber upon compression of the pressure chamber and a one-way valve connects the reservoir to the pressure chamber so as to permit hydraulic fluid to flow from the reservoir chamber to the pressure chamber upon decompression of the pressure chamber. The rod and shell assembly structure described in parent application No. 384,276 includes a preferred embodiment of metering orifice for practice of this invention.

According to this invention, the reservoir chamber is sealed, and the reservoir chamber contains a void space above the fluid in the reservoir chamber wherein an inert pressurized gas is present, applying gas pressure to the storage quantities of hydraulic fluid therein. Thus, the hydraulic fluid flow from the reservoir into the pressure chamber through the one-way valve is generated by the gas pressure inside the reservoir chamber which takes place upon decompression of the pressure chamber. Then the positive gas pressure inside the sealed reservoir chamber forces open the one-way valve and forces the hydraulic fluid out of the reservoir, the gas pressure acting thereby as a takeup spring. When the pressure chamber is compressed by piston movement, the gas pressure is overcome, and the valve is closed. Hydraulic fluid flows from pressure chamber to reservoir by way of the metering orifice.

The pressure chamber is, of course, also sealed, so that the hydraulic valve lifter constitutes a sealed system with the hydraulic fluid and inert gas isolated therein.

Advantageously, the inert gas in the reservoir chamber is charged thereinto at ambient pressure, and then a modest positive gas pressure in the reservoir chamber is generated by flow of hydraulic fluid into the sealed reservoir chamber when the shell and rod components of the hydraulic lifter assembly are brought together. Later, when the hydraulic lifter assembly is mounted on the internal combustion engine, the final fit generates the working gas pressure level inside the reservoir chamber.

DETAILED DISCUSSION OF THE INVENTION

Figure 2:
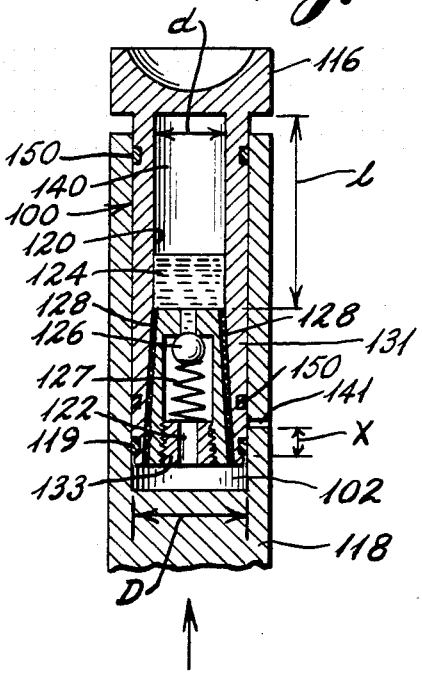

Detailed discussion of this invention will be made with reference to the attached drawing whereon:

FIG. 1 diagrammatically illustrates how a hydraulic valve lifter embodying the practices of this invention relates to the engine cylinder; and FIG. 2 diagrammatically illustrates the sealed system hydraulic valve lifter of this invention.

Illustrated is a hydraulic lifter embodying the concepts of co-pending parent application, Ser. No. 384,276, as well as the principles of the present invention, reference being made to the parent application for more detailed description of the valve lifter structure.

It may be seen in the drawing, that the hydraulic valve lifter 100 comprises a piston-shell 116 that fits inside of a cylindrical cavity 102 of diameter D in the push rod cylinder 118. One state-of-the-art lubricated sealing ring 119 allows relative movement between shell and piston, yet effectively seal a body of hydraulic fluid 124 inside of the lifter. Between the base of piston-shell 116 and the base of cylinder cavity 102 is left a fluid filled region that forms part of the pressure chamber 122 inside the hydraulic lifter 100.

Piston-shell 116 contains a central cylindrical cavity of diameter d, the upper portion of which constitutes the reservoir chamber 120 for an appropriate storage quantity of the hydraulic fluid 124. A pressurized inert gas is in the void space 140 above the hydraulic fluid reservoir. Check valve ball 126 allows one-way passage of the hydraulic fluid 124 from the reservoir chamber 120 into the pressure chamber 122. A valve spring 127 is provided to seat the check valve ball 126 closing the one-way valve, except when the gas pressure in void space 140 of reservoir chamber 120 overbalances spring 127 and forces the valve open. When relative movement of piston-shell 116 and cylinder 118 compress pressure chamber 122 and the pressure on the hydraulic fluid closes the one-way valve, the hydraulic fluid flows from pressure chamber 122 into reservoir chamber 120 by way of an orifice 128.

As is described in detail by the aforementioned parent application, Ser. No. 384,276, the check valve and the orifice 128 through which the hydraulic fluid returns from the pressure chamber to the reservoir may be formed as an assembly that can be press fitted into the piston-shell 116. Such an assembly comprises a check valve block 131 (made from bar stock) which has formed thereon: a set of external threads that will constitute the orifice passageway 128; a central cavity wherein check valve ball 126 will fit; an aperture in the front face whereon valve ball 126 seats, and internal threads at the base of valve block 131. After check valve ball 126 and its valve spring 127 are inserted in the central cavity of block 131 these members are retained in position by mounting an apertured threaded nut 133 in the base of valve block 131. The base end of piston-shell 116 may be tapered as illustrated so that the sub-assembly, of which check valve block 131 in part, fits into piston-shell 116 to form orifice 128 and to separate the reservoir cavity 120 from pressure chamber 122.

In operation, when upward force is applied by the cam, the lifter acts in conventional fashion as a hydraulic lifter. Then, orifice 128 prevents rapid flow of hydraulic fluid therethrough into reservoir chamber 120, and hydraulic lifter 100 functions as a rigid member as is desired. However, upon return movement of the valve cam, pressure chamber 122 becomes decompressed. Then the gas pressure inside of sealed reservoir chamber 120 is sufficient to overcome the bias of valve spring 127, forcing open the check valve 126, whereupon hydraulic fluid flows rapidly from the reservoir 124 into the pressure chamber 122. It may be noted that in the hydraulic valve lifter of the present invention, no takeup spring is present to serve the same function of opening the one-way valve and returning the complete assembly to zero clearance within the valve train.

GAS PRESSURE AS A RETURN SPRING

In practice of this invention, the pressure of gas inside the void space 140 of reservoir chamber 120 is sufficient to overcome the check valve spring 127 and to generate relative movement between cylinder 118 and piston-shell 116 when hydraulic valve lifter 100 is decompressed.

Accordingly, a predetermined level of gas pressure must be provided, namely enough gas pressure to overbalance spring 127 upon decompression, but not so much gas pressure as to unload the engine valve spring. Actually, a relatively low pressure level e.g., 20 psig will suffice to operate the hydraulic valve lifter and gas pressures of this magnitude can be generated without need to provide a gas port into void space 140 so as to introduce pressurized gas.

Two gas pressure levels ($P_1$ $P_2$) are of importance to employment of gas pressure for operation of the hydraulic lifter, and a third level $P_3$ is of interest for assembly of the hydraulic valve lifter. $P_2$ and $P_1$ are, of course, the pressures at the extreme relative positions of piston-shell 116 and cylinder 118, namely, when reservoir 124 is respectively most full and most empty with hydraulic fluid. The relation of $P_1$ and $P_2$ is determined almost exactly by the dimensions of the piston-shell and cylinder, since these dimensions and the quantity of hydraulic fluid introduced into reservoir 124 when the reservoir is most full establish the free space volume 140 at $V_2$. Correspondingly, the volume $V_1$ is when reservoir 124 is completely empty of hydraulic fluid.

The operational piston displacement, X, for the extreme displacement of cylinder from piston-shell, illustrated in the drawing, generates a volume decrease ($V_1$ to $V_2$) inside free space 140, which according to the ideal gas laws, which apply to the sealed hydraulic valve lifter, results in the pressure change of $P_1$ to $P_2$ since $$P_1V_1 = P_2V_2$$

The volumetric change in void space 140 attributable to a piston displacement X in the pressure chamber of diameter D is:

$$\frac{\pi D^2}{4} X$$

$V_1$ is equal to the dimensions of the void space in cavity 140; or $$V_1 = \frac{\pi d^2}{4} l$$

The relationship of $P_1$ to $P_2$ then is $$P_2 = \frac{P_1V_1}{V_2} = \frac{P_1V_1}{V_1 - \frac{\pi D^2}{4} X} = \frac{P_1}{1 - \frac{\pi D^2}{4} X/V_1}$$

since:

$$\frac{\pi D^2}{4} X/V_1 = \frac{\pi D^2}{4} X / \frac{\pi d^2}{4} l = \frac{D^2X}{d^2l}$$

$$P_2 = \frac{P_1}{1 - \frac{D^2X}{d^2l}}$$

Appropriate selection may be made for $P_2$ by the various dimensions X, l, d and D as well as for the engine valve spring preload. At full displacement X when void space 140 is at V2, the $P_2$ pressure will not unload the engine valve spring. Exemplary relations are d=0.5", l=1.0", D=0.75", and $P_2$=20 psig. In this exemplary valve lifter $P_2$=20 psig provides a takeup force of somewhat less than about ten pounds, yet is sufficient to overcome the friction of seal 119 and the friction from the valve train elements such as the rocker arm. X is approximately ½".

ASSEMBLY METHOD

An important aspect of this invention is that satisfactory operating pressures $P_1$ and $P_2$ inside void space 140 are generated during assembly of the hydraulic valve lifter 100 from piston-shell 116, cylinder 118 and the subassembly of check valve block 131.

First, the reservoir cavity 120 is purged with inert gas, suitably nitrogen, then the check valve sub-assembly of valve block 131 is installed in piston-shell 116. Thereafter, both the cavity 102 in cylinder 118 and the void space inside valve block 131 are filled with the hydraulic fluid being filled completely to the top, to avoid introducing air at the interface. Then, taking care to avoid air bubbles, the cylinder 118 and the piston-shell 116 are brought together, the piston-shell 116 sliding inside the cylinder cavity 102. As the piston-shell 116 and cylinder 118 come together shrinking cavity 102, the lower seal 119 prevents leakage of hydraulic fluid, trapping the hydraulic fluid so that all of the excess hydraulic fluid is expelled through a port 141, which, for example, is located 1¾" from the top of 118. Little, if any, hydraulic fluid flows through orifice 128 until the seal 119 has advanced past port 141. Once seal 119 passes port 140 and cavity 102 shrinks further, the hydraulic fluid therein has no exit from cavity 102, save through orifice 128 into reservoir chamber 120. In turn, flow of hydraulic fluid into reservoir chamber 120 compresses the inert gas in an ever shrinking void space 140.

The assembly process is halted before the cavity 102 has been shrunk to the final size. Otherwise, when the assembly force is released, the piston will move back outward to an equilibrium position, at which $X=1/16$: and $P_3=5$ psig.

The hydraulic valve lifter is intended to be shortened a bit upon installation on the internal combustion engine. Accordingly, when the force applied during assembly is removed, piston-shell 116 and cylinder 118 move apart until an equilibrium establishes itself between the internal pressure $P_3$ in void space 140 and the seal friction. At the equilibrium pressure of $P_3$ in void space 140, the friction at seal 119 and pressure $P_3$ are in balance. Thereby the hydraulic valve lifter 100 has become a sealed unit. To disassemble the lifter, the piston-shell and cylinder must be pulled apart.

Port 141 is located along the length of cylinder 118 so as to generate the desired pressure, $P_2$, in void space 140 by forcing appropriate reservoir quantities of hydraulic fluid into the reservoir chamber.

To repeat, the hydraulic valve lifter is left oversized, so to speak, and must be compressed upon installation on the internal combustion engine. Only then is the operating gas pressure generated inside void space 140. Moreover, the lifter remains sealed after removal from the engine, should such become necessary. Disassembly of the hydraulic lifter itself requires application of tension forces to separate piston-shell 116 from cylinder 118.

To size the orifice 128 and to establish final design parameters for the gas filled hydraulic valve lifter of this invention, the test procedure and equipment described in patent application, Ser. No. 384,276, may be employed.

The sealed character of the lifter assembly made according to practice of this invention, allows selection of hydraulic fluid entirely for favorable viscosity characteristics.

In regard to properties desired in the hydraulic fluid, no real requirement for lubrication exists. The predominant property for the fluid is its viscosity characteristics. The hydraulic fluid simply circulates through the orifice and check valve. Use of relatively volatile fluids is possible since the fluid is always under a positive pressure suppressing thereby evaporation and bubble formation, as well as use of hydraulic fluids that would be oxidized by an air atmosphere. Thus, fluid viscosity changes over time and contamination with foreign particles do not take place.

The bearing surfaces on the the piston and on the cylinder, do, however, require boundary lubrication for which purposes a heavy viscous grease-like composition can be employed, because there is no fluid flow between the bearing surfaces and relatively little motion between piston and cylinder. The hydraulic fluid would make a poor lubricant for the bearing surfaces. Teflon rider rings 150 might be employed in addition to sealing ring 119.

One last point should be made regarding oxidation and lubrication. First certain fluids of possible interest for practice of this invention can be oxidized by or can cause oxidation of the wall surfaces. Chemical treatment such as phosphate coating of the piston and shell may be useful. Such coatings have an additional advantage since they help retain the lubrication for sealing rings 119.

I claim:

1. A valve lifter assembly comprising a cylinder and a piston-shell assembly, said assembly comprising an enclosed unobstructed reservoir chamber, a pressure chamber and hydraulic fluid in said chambers, one portion of said piston-shell assembly slidably fitting in said pressure chamber, a metering orifice between and connecting said reservoir chamber and said pressure chamber, a one-way valve between and permitting fluid flow from said reservoir chamber to said pressure chamber, and a void space in said reservoir chamber directly above the hydraulic fluid reservoir therein, said void space containing a pressurized inert gas, the gas pressure directly generating all force thereby to open said one-way valve and permit flow of hydraulic fluid from reservoir to said pressure chamber.

2. A valve lifter assembly as in claim 1 further comprising:

a helically threaded body containing said valve, said piston-shell assembly immovably supporting said body so that the metering orifice is formed between said helically threaded body and the support thereof.

3. A method for assembly of a gas filled valve lifter assembly comprising an enclosed unobstructed reservoir chamber, a pressure chamber and hydraulic fluid in said chambers, one portion of said piston-shell slidably fitting in said pressure chamber, a metering orifice between and connecting said reservoir chamber and said pressure chamber, a one-way valve between and permitting fluid flow from said reservoir chamber to said pressure chamber, and a void space in said reservoir chamber directly above the hydraulic fluid reservoir therein, said void space containing a pressurized inert gas, the gas pressure directly generating all force thereby to open said one-way valve and permit flow of hydraulic fluid from reservoir to said pressure chamber, which comprises filling the pressure chamber cavity with hydraulic fluid and filling the reservoir chamber with inert gas, then bringing a surrounding cylinder and said piston-shell slidably together to seal said pressure chamber whereby hydraulic fluid flows through said metering orifice into said reservoir chamber to form a fluid reservoir therein and to compress the inert gas therein.

* * * * *